United States Patent [19]

Suzuki

[11] Patent Number: 4,785,707

[45] Date of Patent: Nov. 22, 1988

[54] TONE SIGNAL GENERATION DEVICE OF SAMPLING TYPE

[75] Inventor: Hideo Suzuki, Hamamatsu, Japan

[73] Assignee: Nippon Gakki Seizo Kabushiki Kaisha, Hamamatsu, Japan

[21] Appl. No.: 919,859

[22] Filed: Oct. 16, 1986

[30] Foreign Application Priority Data

Oct. 21, 1985 [JP] Japan ..... 60-233560

[51] Int. Cl.[4] ..... G10H 1/02; G10H 1/12; G10H 7/00

[52] U.S. Cl. ..... 84/1.19; 84/1.24; 84/1.28; 84/DIG. 10; 364/724.01

[58] Field of Search ..... 84/DIG. 10, 1.01, 1.03, 84/1.11–1.13, 1.19–1.28, DIG. 9; 364/724; 381/51

[56] References Cited

U.S. PATENT DOCUMENTS

| | | | |
|---|---|---|---|
| 4,176,578 | 12/1979 | Campbell | 84/1.1 |
| 4,193,332 | 3/1980 | Richardson | 84/1.01 |
| 4,215,617 | 8/1980 | Moorer | 84/1.03 |
| 4,265,157 | 5/1981 | Fricke et al. | 84/1.01 |
| 4,461,199 | 7/1984 | Hiyoshi | 84/1.19 |
| 4,463,650 | 8/1984 | Rupert | 84/1.01 |
| 4,596,032 | 7/1986 | Sakurai | 84/1.01 |
| 4,602,545 | 7/1986 | Starkey | 84/1.01 |
| 4,633,748 | 1/1987 | Takashima | 84/1.28 |

FOREIGN PATENT DOCUMENTS 54-161313 12/1979 Japan .

*Primary Examiner*—Stanley J. Witkowski
*Attorney, Agent, or Firm*—Spensley Horn Jubas & Lubitz

[57] ABSTRACT

In a tone signal generation device, original waveshape amplitude data corresponding to a waveshape signal from an external source is stored in a first memory. Waveshape data is read out from this first memory and is properly modified by a tone processing circuit such as a filter or a modulation effect circuit. The modified waveshape data is reserved in a second memory. The waveshape data stored in the second memory is selectively transferred to the first memory. In this manner, the original waveshape data initially stored in the first memory can be freely modified and a tone can be produced with a high degree of freedom as in a music synthesizer.

13 Claims, 2 Drawing Sheets

TONE SIGNAL GENERATION DEVICE OF SAMPLING TYPE

BACKGROUND OF THE INVENTION

This invention relates to a tone signal generation device used in an electronic musical instrument and other tone generation devices and, more particularly, to an improvement in a tone signal generation device of a type in which a waveshape signal provided from outside is sampled and stored and a tone signal is generated on the basis of this stored data.

An electronic musical instrument in which a waveshape signal provided from outside is sampled and stored and a tone signal is generated on the basis of the stored data is disclosed in Japanese Preliminary Patent Publication No. 54-161313. In this device, a waveshape signal provided from outside of the device is stored in a memory, a waveshape signal is read out from the memory by depressing a key in a keyboard and a tone signal is generated by subjecting the read out waveshape signal to a series of processings including filtering. The waveshape signal which has once been stored in the memory is not rewritten unless another waveshape signal is introduced from outside so that synthesis of a desired tone (making of a tone) is effected solely by subjecting waveshape signal introduced from outside to tone processings such as filtering.

The waveshape of the the waveshape signal introduced from outside, however, can be modified only in an auxiliary fashion by subjecting the waveshape signal introduced from outside to tone processings such as filtering and tone effect imparting and it is not possible by such method to modify the waveshape to a large extent and thereby make a tone with a high degree of freedom.

SUMMARY OF THE INVENTION

It is, therefore, an object of the invention to provide a tone signal generation device according to which, in producing a tone signal on the basis of a waveshape signal introduced from outside, a tone can be synthesized with a high degree of freedom as in generation of a tone by a music synthesizer.

For achieving this object, the tone signal generation device of this invention is characterized in that it comprises first memory means capable of reading and writing, external signal input means for sampling waveshape data from a waveshape signal provided from outside and writing the sample waveshape data in the first memory means, readout means for reading out the waveshape data stored in the first memory means, waveshape processing means for processing the waveshape data read out from the first memory means and thereby modifying waveshape corresponding to the waveshape data, second memory means for storing the waveshape data processed by the waveshape processing means and transfer control means for transferring the waveshape data stored in the second memory means to the first memory means.

Initially, sample original waveshape data from outside is stored in the first memory means. This waveshape data is read out by the readout means. The read out waveshape data is processed by the waveshape processing means and the waveshape corresponding to the waveshape data is modified in accordance with the waveshape processing. This waveshape data having been processed by the waveshape processing means is stored in the second memory means. The waveshape data stored in the second memory means is transferred to the first memory means and stored therein if necessary under the control of the transfer control means.

According to this invention, therefore, the waveshape data stored in the first memory means initially is the original waveshape data sampled from outside but thereafter can be waveshape data with a modified waveshape. By utilizing this construction, waveshape data whose waveshape has been modified can be applied to the waveshape processing means to further modify its waveshape and a tone synthesis can be effected with a high degree of freedom by repeating this loop.

An embodiment of the invention will now be described with reference to the accompanying drawings.

BRIEF DESCRIPTION OF THE DRAWINGS

In the accompanying drawings.

DESCRIPTION OF A PREFERRED EMBODIMENT

Figure 1:
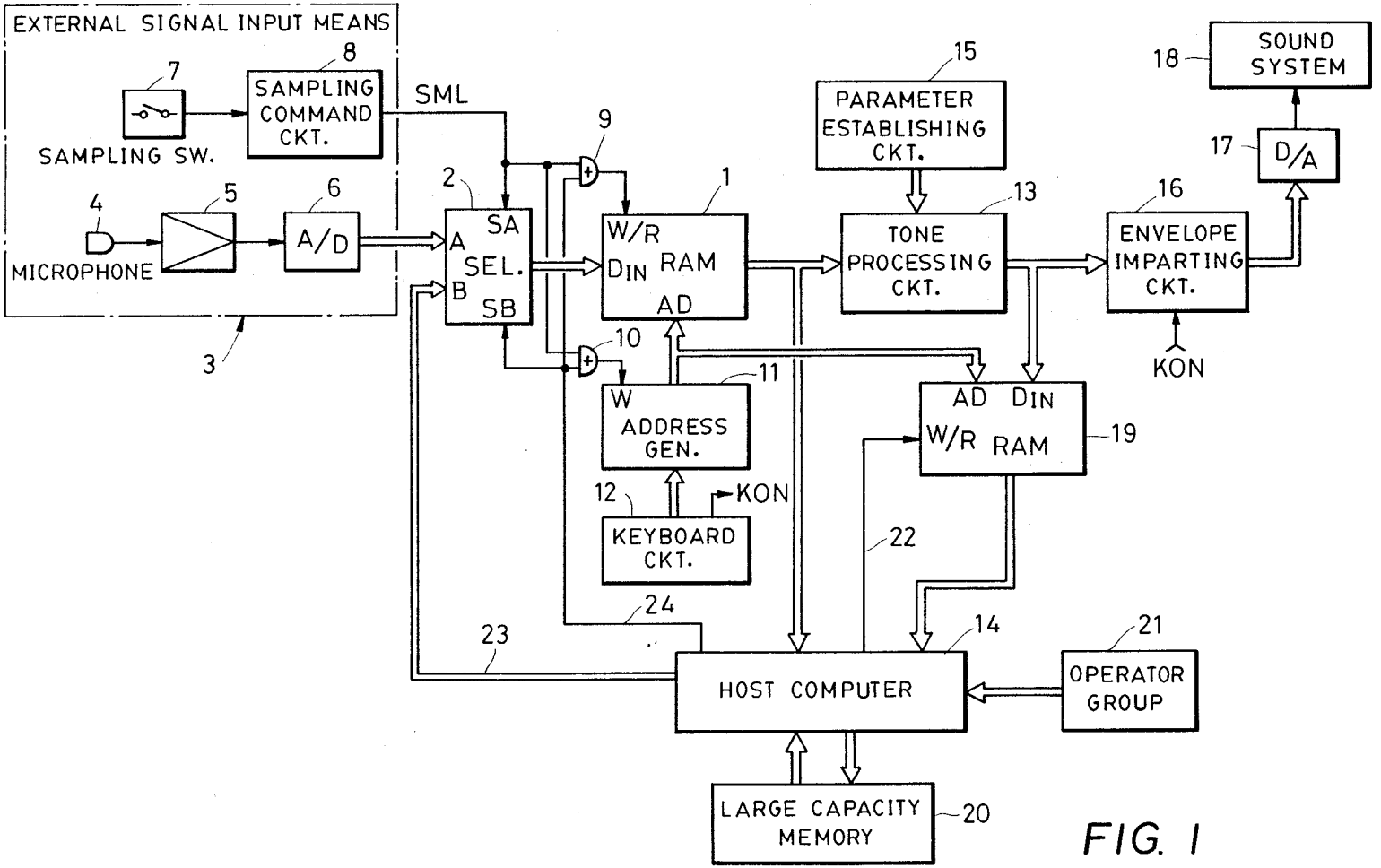
FIG. 1 is an electrical block diagram showing an embodiment of the tone signal generation device according to the invention.

In FIG. 1, a main random-access memory (hereinafter referred to as "RAM") 1 constitutes the first memory means. Waveshape data applied to data input DIN of the main RAM 1 via a selector 2 can be written in the main RAM 1 and read out therefrom. In external signal input means 3, an external waveshape signal is picked up by a microphone 4 and applied through an amplifier 5 to an analog-to-digital converter 6 to be converted into a digital signal. The digitized signal is applied to an A-input of the selector 2. In the external signal input means 3, a signal "1" is produced as a sampling command signal SML by a sampling command circuit 8 for a predetermined period of time in accordance with operation of a sampling switch 7 and this signal is applied to an A selection control input SA of the selector 2 and also to a read-write control input W/R of the main RAM 1. Further, the sampling command signal SML is applied to a control input W of an address generator 11 through an OR gate 10.

The address generator 11 sequentially generates an address signal used for writing at a predetermined rate while the signal "1" is being applied to the control input W and supplies this address signal to an address input AD of the main RAM 1. When the signal at the control input W is "0", the address generator 11 sequentially generates an address signal used for reading at a rate corresponding to a key code KC provided by a keyboard circuit 12. The keyboard circuit 12 includes key switches corresponding to keys for designating tone pitches of tones to be generated. The keyboard circuit 12 detects a depressed key and produces a key code KC corresponding to the depressed key and a key-on signal KO corresponding to the key depressing operation.

Description will now be made about sampling of original waveshape data from a waveshape signal provided from outside. A desired tone signal is sounded by playing for example a natural musical instrument and this tone signal is picked up by the microphone 4. Simultaneously, the sampling switch 7 is manipulated for producing the sampling command signal SML which is "1" for a predetermined period of time. The A-input of the selector 2 thereby is selected and the digitized sampled external waveshape data is supplied to the data input DIN of the main RAM 1. The main RAM 1 is turned to a write mode and the address signal for writing is sequentially generated by the address generator 11 at a predetermined rate. Thus, a set of sampled external original waveshape data is written in the main RAM 1. Upon turning of the sampling command signal SML to "0", writing of the data is completed and the main RAM 1 is turned to a read mode. The set of waveshape data written in the main RAM 1 is either full waveshape data of an entire section from the start of sounding of a tone to the end thereof or a suitable partial waveshape data of such full waveshape data.

For reading out waveshape data stored in the main RAM 1, a desired key in the keyboard is depressed and a key code KC corresponding to this key is produced by the keyboard circuit 12. In response to this key code KC, the address signal is generated by the address generator 11 at a rate corresponding to the tone pitch of the tone of the depressed key and the waveshape data stored in the main RAM 1 thereby is read out. The read out waveshape data is supplied to a tone processing circuit 13 and a host computer 14.

The tone processing circuit 13 executes in real time processings for changing the waveshape of input waveshape data. The tone processing circuit 13 may comprise a digital filter, a digital modulation effect imparting circuit and various other tone control means. The circuit 13 is capable of establishing tone control parameters in a parameter establishing circuit 15 and synthesizing a tone desired by the player in accordance with these tone control parameters. A tone signal provided by the tone processing circuit 13 is imparted with an amplitude envelope by an envelope imparting circuit 16, converted to an analog signal by a digital-to- analog converter 17 and thereafter is supplied to a sound system 18 for sounding of the tone.

The tone signal provided by the tone processing circuit 13, i.e., the processed waveshape data, is applied in real time to a data input DIN of a sub RAM 19. To an address input AD of this sub RAM 19 is applied the address signal generated by the address generator 11 and to a read/write control input W/R thereof is applied a signal from the host computer 14.

There are provided a large capacity memory 20 and an operator group 21 attached to the host computer 14. This memory 20 consists of a large capacity memory device capable of both reading and writing such as a magnetic disk, an optical disk and a magnetic tape and can store plural sets of waveshape data. The operator group 21 include various operators for ordering editing of the waveshape data by the host computer 14. The host computer 14 performs, in accordance with orders given by the operator group 21, a function of controlling reading and writing of the sub RAM 19, a function of implementing waveshape modifying processing in non-real time by receiving the waveshape data read out from the main RAM 1 and the sub RAM 19 and subjecting the waveshape data to a proper operation, a function of storing the waveshape data provided by the main RAM 1 and the sub RAM 19 and the waveshape data obtained by the above operation in the large capacity memory 20 and reading them out from the memory 20, and a function of writing the waveshape data read out from the sub RAM 19 and the large capacity memory 20 in the main RAM 1.

For writing the waveshape data in the sub RAM 19, an operator in the operator group 21 for ordering writing in the sub RAM 19 is operated and, in response to this operation, a signal "1" ordering writing is supplied to the read/write control input W/R of the sub RAM 19 through a line 22. When waveshape data is read out from the main RAM 1 in accordance with the key depression, the same address signal as is used for this reading is applied to the address input AD of the sub RAM 19 designating a write address. In this manner, waveshape data whose waveshape has been modified by the tone color establishing control effected in the tone processing circuit 13 is written in the sub RAM 19.

For writing waveshape data in the main RAM 1, an operator in the operator group 21 for ordering writing in the main RAM 1 is operated and also an operation for reading out desired waveshape data from the sub RAM 19 or the large capacity memory 20 is performed. If necessary, an operation for ordering a processing for subjecting the read out waveshape data to a proper operation is made. In this manner, waveshape data to be written in the main RAM 1 is obtained in accordance with reading from the sub RAM 19 or the large capacity memory 20 and this waveshape data is supplied to a B-input of the selector 2 through a line 23. Simultaneously, a signal "1" is supplied through a line 24 to a B selection control input SB of the selector 2 and OR gates 9 and 10. By a signal "1" supplied from the OR gate 9 to the input W/R, the main RAM 1 is turned to the write mode and by a signal "1" supplied from the OR gate 10 to the input W, the address generator 11 is turned to a mode in which the address signal for writing is generated at the predetermined rate. In this manner, the waveshape data provided from the host computer 14 through the line 23 is written in the main RAM 1. The waveshape stored in the main RAM 1 thereby is rewritten to one which is different from the waveshape which was sampled from outside by the external signal input means 3 (i.e., rewritten to one which has been modified from the one sampled from outside). The stored waveshape in the main RAM 1 which has thus been rewritten can be read out in the same manner as desribed above and can be suitably modified and the stored waveshape in the main RAM 1 can be further rewritten by this waveshape.

An example of editing of a tone waveshape will now be described.

(EXAMPLE 1)

Figure 2:
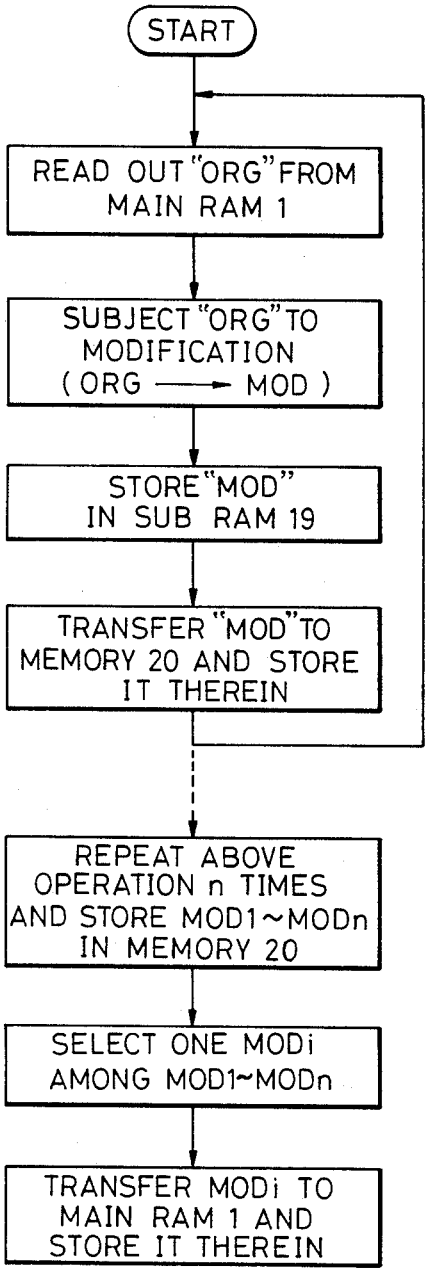
FIG. 2 is a flow chart schematically showing an example of a processing for editing waveshape data executed by using this embodiment.

An outline of the editing routine in this Example 1 is shown in FIG. 2.

Original waveshape data (referred to as "ORG") sampled from outside which is stored in the main RAM 1 is read out and is subjected to a desired modification in the tone processing circuit 13 to obtain modified waveshape data (referred to as "MOD"). This MOD data is once stored in the sub RAM 19. Then the waveshape data MOD stored in the sub RAM 19 is transferred to the large capacity memory 20 and stored therein. The above described operation is repeated plural times (n times) with the contents of the tone color establishing control being changed every time and plural sets of modified waveshape data MOD1 through MODn are stored in the large capacity memory 20. A desired one MODi among these modified waveshape data MOD1 through MODn is selected and transferred to the main RAM 1 and stored therein. Thus, the contents stored in the main RAM 1 are rewritten from the original waveshape data ORG to the modified waveshape data MOD.

(EXAMPLE 2)

Figure 3:
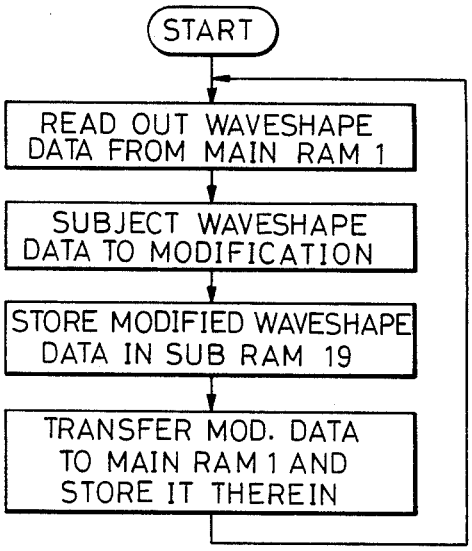
FIG. 3 is a flow chart schematically showing another example of the above processing for editing waveshape data.

An outline of the editing routine of this Example 2 is shown in FIG. 3.

The original waveshape data in the main RAM 1 is read out, is subjected to a desired modification and thereafter is stored in the sub RAM 19. Modified waveshape data MOD1 stored in the sub RAM 19 is transferred to the main RAM 1 and stored therein. In this manner, the stored waveshape data in the main RAM 1 is rewritten from the waveshape data ORG to the waveshape data MOD1. Then, the MOD1 waveshape data is read out from the main RAM 1 and is subjected to a desired modification in the tone processing circuit 13 and thereafter is stored in the sub RAM 19. Modified waveshape data MOD2 stored in the sub RAM 19 is transferred to the main RAM 1 and stored therein. By repeating this processing by a suitably number of times, a desired tone waveshape is formed and this tone waveshape is stored in the main RAM 1.

(EXAMPLE 3)

Figure 4:
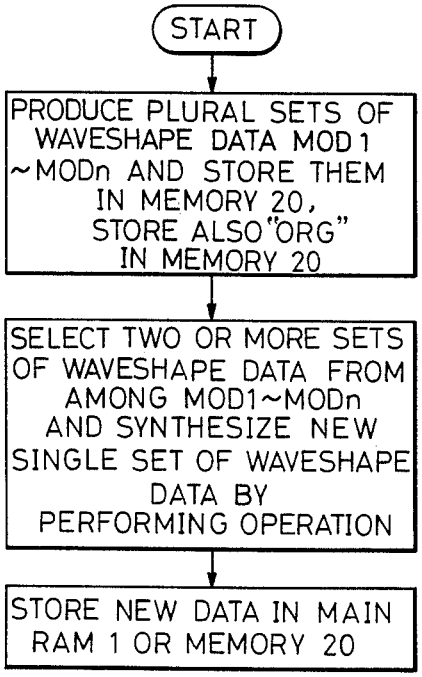
FIG. 4 is a flow chart schematically showing still another example of the above processing for editing waveshape data.

An outline of editing of this Example 3 is shown in FIG. 4.

In the same manner as in the above described Example 1, plural sets of modified waveshape data MOD1 through MODn are produced and stored in the large capacity memory 20. The ORG waveshape data read out from the main RAM 1 is stored also in the large capacity memory 20. Desired two or more sets of waveshape data are selected from among the plural sets of waveshape data stored in the large capacity memory 20 and a new single set of waveshape data NEW is synthesized by performing a suitable operation. The synthesized waveshape data NEW is stored in the main RAM 1 (or stored in the large capacity memory 20 to be utilized for another waveshape synthesizing operation). Various methods are available for the waveshape synthesizing operation such, for example, as producing a new waveshape by connecting an attack portion of the original waveshape data ORG and a sustain portion of the modified waveshape data MOD. For achieving a smooth connection at the junction of the two portions, a crossfade interpolation operation should preferably be employed according to which the waveshape of the former portion is decayed with a decay envelope, the waveshape of the latter portion is caused to rise, crossing the former waveshape, with an attack envelope and the two waveshape portions are added together.

The Examples 1 through 3 are only examples and the editing of the waveshape can be effected in various other methods. For example, the methods of Examples 1, 2 and 3 may be suitably combined to produce a new tone source waveshape and this new tone waveshape may be finally stored in the main RAM 1.

What is claimed is:

1. A tone signal generation device comprising:

first memory means, capable of reading and writing, for storing data of waveshape sample point amplitude values of a tone of first specific tone color;

external signal input means for sampling waveshape amplitude data from a waveshape signal provided from outside of said device and writing the sampled waveshape amplitude data in said first memory means;

readout means for reading out the waveshape data stored in said first memory means;

waveshape processing means for processing the waveshape data read out from said first memory means into data of waveshape sample point amplitude values of a tone having a second tone color different from said first tone color;

second memory means for storing the processed waveshape data; and transfer control means for transferring the waveshape data from said second memory means to said first memory means.

2. A tone signal generation device as defined in claim 1 wherein said readout means is connected to a keyboard comprising keys for selecting a note of a tone to be generated and reads out the waveshape data from said first memory means at a rate corresponding to the note of a key depressed in the keyboard.

3. A tone signal generation device as defined in claim 1 wherein said waveshape processing means comprises parameter establishing means for selectively establishing parameters used for waveshape processing and a circuit for processing the waveshape data in accordance with the parameters established by said parameter establishing means.

4. A tone signal generation device as defined in claim 1 wherein said waveshape processing means comprises a digital filter.

5. A tone signal generation device as defined in claim 1 wherein said waveshape processing means comprises a digital modulation effect circuit.

6. A tone signal generation device as defined in claim 1 wherein said waveshape processing means comprises first processing means for processing the waveshape data read out from said first memory means in real time for sounding a tone which corresponds to the processed data and second processing means for processing this waveshape data in non-real time by subjecting the data to an editing operation before sounding a tone.

7. A tone signal generation circuit as defined in claim 1 wherein said second memory means comprises a first memory section receiving a set of waveshape data provided by said waveshape processing means in real time and a second memory section being capable of storing plural sets of waveshape data and storing the set of waveshape data received by said first memory section thereby reserving plural sets of modified waveshape data, and said transfer control means selects one set from among said plural sets of waveshape data stored in said first and second memory sections.

8. A tone signal generation device as defined in claim 1 wherein said waveshape processing means synthesizes a set of modified waveshape data by processing the set of waveshape data read out from said first memory means, said second memory means is capable of storing respective plural sets of waveshape data, said transfer control means selects one set from among the plural sets of waveshape data stored in said second memory means and transfers the selected data to said first memory means, and said waveshape processing means performs processings plural times with contents of processings being different and plural sets of modified waveshape data which are different from one another are thereby synthesized and the respective sets of synthesized waveshape data are stored in said second memory means.

9. A tone signal generation means as defined in claim 1 wherein the waveshape data stored in said first memory means is established in a desired state by repeating at least once steps of reading out from said first memory means the waveshape data transferred from said second memory means to said first memory means, modifying this waveshape data by said waveshape processing means, storing this modified waveshape data in said second memory means and transferring this modified waveshape data from said second memory means to said first memory means.

10. A tone signal generation device as defined in claim 1 wherein said second memory means is capable of storing respective plural sets of waveshape data and stores one or more sets of waveshape data modified by said waveshape processing means which are different from one another, and which further comprises waveshape data synthesizing means for synthesizing a set of new waveshape data by reading out plural sets of waveshape data from said second memory means and subjecting these plural sets of waveshape data to an operation processing.

11. A tone signal generation device as defined in claim 10 wherein said second memory means further stores a set of original waveshape data in the form read out from said first memory means.

12. A tone signal generation device as defined in claim 10 wherein said waveshape data synthesizing means synthesizes said new set of waveshape data by connecting selected portions of plural sets of waveshape data.

13. A tone signal generation device as defined in claim 12 wherein said waveshape data synthesizing means performs a crossfade interpolation operation so as to provide a smooth transition between the selected portions of the plural sets of waveshape data that are being connected.

* * * * *